US008689714B1

(12) United States Patent
Ramotowski

(10) Patent No.: US 8,689,714 B1
(45) Date of Patent: Apr. 8, 2014

(54) ELECTROCHEMICAL BUOYANCY ENGINE FOR AUTONOMOUS UNDERSEA PLATFORMS

(75) Inventor: Thomas S. Ramotowski, Tiverton, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 194 days.

(21) Appl. No.: 12/868,876

(22) Filed: Aug. 26, 2010

(51) Int. Cl.
*B63B 39/03* (2006.01)

(52) U.S. Cl.
USPC ..... 114/125

(58) Field of Classification Search
USPC ..... 205/637, 638, 639; 114/121, 125, 245, 114/333
See application file for complete search history.

(56) References Cited

U.S. PATENT DOCUMENTS

| | | | | |
|---|---|---|---|---|
| 3,648,668 | A * | 3/1972 | Pacheco | 123/3 |
| 3,942,511 | A * | 3/1976 | Black et al. | 126/263.05 |
| 6,719,889 | B2 * | 4/2004 | Brown | 205/230 |
| 8,100,074 | B2 * | 1/2012 | Cameron et al. | 114/125 |

* cited by examiner

*Primary Examiner* — Stephen Avila
*Assistant Examiner* — Anthony Wiest
(74) *Attorney, Agent, or Firm* — James M. Kasischke; Michael P. Stanley

(57) ABSTRACT

An electrochemical engine for buoyancy is provided with the engine having a water-tight and gas-tight chamber containing a volume of seawater. The electrochemical buoyancy engine contributes electrons for reduction of hydrogen protons in the seawater using a sufficient voltage applied to an anode and a cathode disposed in the seawater. The generated hydrogen gas is held in the chamber to provide the desired buoyancy and can be vented to adjust the buoyancy.

1 Claim, 2 Drawing Sheets

ELECTROCHEMICAL BUOYANCY ENGINE FOR AUTONOMOUS UNDERSEA PLATFORMS

STATEMENT OF GOVERNMENT INTEREST

The invention described herein may be manufactured and used by or for the Government of the United States of America for Governmental purposes without the payment of any royalties thereon or therefor.

CROSS REFERENCE TO OTHER PATENT APPLICATIONS

None.

BACKGROUND OF INVENTION

1) Field of the Invention

The present invention is directed to a device and method of use for producing buoyancy in autonomous undersea sensor platforms.

2) Description of Prior Art

The cation $H^+$ is continuously generated in seawater in accordance with the following chemical equilibrium (units are moles/liter): $[H^+][OH^-]=10^{-14}$.

For autonomous undersea sensor platforms, it is desirable that the platforms be able to adjust their buoyancy so that the platforms can change their depth in a water column. The ability to rise to shallow depths, or even to the surface for brief intervals to send/receive data or instructions is a necessity. In most instances, such a platform will prefer to remain neutrally-buoyant so that the platform can remain at a pre-determined depth. The issue is how to regulate the platform depth while simultaneously minimizing the weight and size of the device or materials that control the operational depth of the platform.

An easy way to affect the depth of such a platform is to generate a gas that is used to increase buoyancy. To rise in the water column, gas is generated. To sink to a lower depth, the previously-generated and stored gas is released.

The necessary amount of gas can be generated using a chemical reaction with materials that are carried or stored on the platform or using a chemical reaction that involves some chemical species present in the ambient environment (i.e., seawater).

Using a chemical reaction with materials stored on the platform is undesirable because the materials require storage of some active material within the platform. This storage uses payload space and weight that can be used for other functions (sensing, power, etc.). In addition, depletion of the stored active material changes the overall buoyancy of the platform; thereby, limiting the duration of the mission. The stored active material is a finite resource that cannot be replenished once the platform is deployed.

Using a chemical reaction that involves some chemical species present in the ambient environment is more desirable, because the raw materials necessary for the chemical reaction to function are present at the platform after deployment. A suitable chemical reaction could take advantage of the two gases (hydrogen and oxygen) that can be generated when water is broken down by electrolysis: $2H_2O \rightarrow 2H_2\,(g)+O_2\,(g)$.

The problem with the use of electrolysis is the considerable amount of energy that is required to break the chemical bonds in water between hydrogen and oxygen. Using a system and process based on electrolysis requires the dedication of a significant portion of the platform power supply to water electrolysis (an undesirable outcome that would unnecessarily limit the size and power of the platform payload).

SUMMARY OF THE INVENTION

Exemplary embodiments of the present invention are directed to systems and methods that use an electrochemical reaction (i.e., the reduction of $H^+$ in seawater), to generate hydrogen which can be used to adjust the buoyancy of autonomous undersea sensor platforms. This operation allows these platforms to change their operating depth in the water column.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein like reference numerals and symbols designate identical or corresponding parts throughout the several views and wherein.

DETAILED DESCRIPTION OF THE INVENTION

Figure 1:
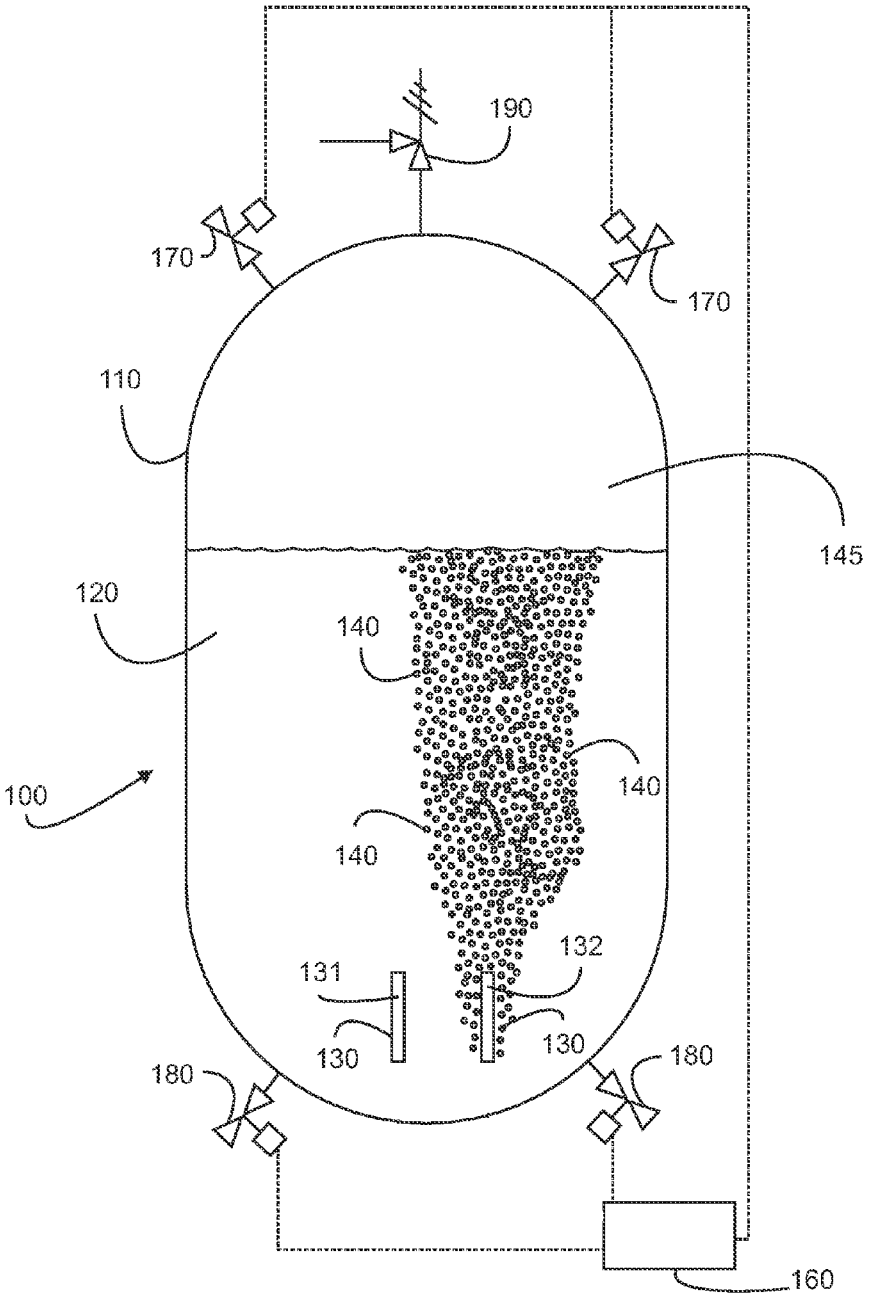
FIG. 1 is a schematic of an embodiment of an electrochemical buoyancy engine in accordance with the present invention.

Systems and methods in accordance with exemplary embodiments of the present invention generate gas (e.g., hydrogen gas) from an electrolyte (e.g., seawater using a lower expenditure of energy) than is required in hydrolysis or electrolysis reactions. Embodiments of the present invention take advantage of the following electrochemical reaction:

$$2H^+ + 2e^- \rightarrow 2H \rightarrow H_2\,(g) \quad (1)$$

This reaction generates hydrogen gas on the surface of a metal that is maintained at a proper cathodic voltage. In one embodiment, the proper cathodic voltage is greater (i.e., more cathodic) than −1000 mV versus a standard Calomel electrode (SCE). The energy required to drive the reaction is significantly lower than the energy required for water electrolysis. Breaking a H—OH bond requires about 119 kcals/mole of energy. By contrast, the electrochemical reduction of $H^+$ to H does not require any bonds to break.

The present invention does not require the breaking of any chemical bonds as in electrolysis and only requires a metal anode; a metal cathode and a power supply that can provide sufficient voltage as well as a current for the reduction reaction to occur. Therefore, both the volume of units using the reduction reaction and the power required are minimized.

Exemplary embodiments of electrochemical buoyancy engines in accordance with the present invention minimize buoyancy engine volume. The volume is minimized as the material providing buoyancy is extracted from seawater and does not need to be stowed onboard. The buoyancy engine weight is minimized as the material providing that buoyancy is extracted from seawater and does not need to be stowed onboard. In addition, the buoyancy engine energy and power requirements are reduced as the reduction of $H^+$ does not require the breaking of any chemical bonds—unlike in the electrolysis of water. The source of the material generating the buoyancy (e.g., seawater as the electrolyte) is effectively inexhaustible; thereby, allowing long-duration missions without the replenishment of the electrolyte.

The desired electric power, voltage and current can be supplied using any suitable electric source including; but not limited to, DC power sources, AC power sources, batteries, generators and solar photovoltaic cells. In one embodiment, solar cells can be used to trickle-charge one or more batteries which in turn are used to supply the necessary voltage to the electrodes. Preferably, the power supply is the same power supply used to power the marine vessel that includes the buoyancy engine.

In one embodiment, the anode and the cathode are made from a variety of different metals. Suitable metals include, but are not limited to, stainless steel, platinum, titanium, carbon-graphite, nickel alloys and other materials known to those skilled in the art. In addition, the cathode can also be constructed from graphite or a graphite-composite to lessen the weight of the cathode.

In one embodiment, the electrochemical buoyancy engine operates without an external voltage source. In this embodiment, anodes and cathodes composed of metals that are spaced as far apart as possible on the galvanic series in seawater are used. In one embodiment, the difference in galvanic potential in seawater between the two materials must be greater (i.e., more cathodic, that −1000 mV versus SCE). Examples include, but are not limited to, magnesium, zinc or aluminum for the anode coupled to platinum, titanium or carbon-graphite for the cathode. In this embodiment, the anode is consumed over a period; of time; thereby, placing a limit on the operational life of the buoyancy engine absent the replacement of the anode.

Referring now to FIG. 1, in accordance with one exemplary embodiment, the present invention is directed to an electrochemical buoyancy engine 100 that includes a water-tight and gas-tight chamber 110 holding a volume of an electrolyte 120. Any suitable electrolyte that can provide a source of protons for use in a reduction reaction to produce hydrogen gas can be used. Preferably, the electrolyte is seawater that is obtained from the ambient environment, and the source of the protons is the hydrogen protons that naturally occur in seawater.

The chamber is constructed of a membrane material that can hold the desired volumes of liquid and gas. Suitable membrane materials include, but are not limited to; polymers, elastomers and combinations thereof. In one embodiment, the chamber is constructed of an expandable membrane material.

The electrochemical buoyancy engine is configured to contribute electrons for the reduction of protons contained in the electrolyte. In one embodiment, the electrochemical buoyancy engine includes a pair of electrodes 130, an anode 131 and a cathode 132 within the chamber 110 and disposed or immersed in the electrolyte 120. In one embodiment, the electrodes 130 are metal electrodes. In another embodiment, the anode is metal and the cathode is constructed from graphite or a graphite composite.

Alternatively, the electrodes 130 are formed of materials that are sufficiently spaced apart on a galvanic series in the electrolyte (e.g., seawater) to drive the contribution of electrons necessary for the proton reduction reaction. In one embodiment, the difference in galvanic potential in seawater between the two materials must be greater, i.e., more cathodic, that −1000 mV versus SCE. Examples include, but are not limited to, magnesium, zinc or aluminum for the anode coupled to platinum, titanium or carbon-graphite for the cathode. The anode and cathode materials are in direct contact or are connected through a conductor such as an electrical wire.

A voltage source 150 is provided in communication with the two electrodes and is configured to generate a sufficient voltage and current to contribute the electrons for proton reduction. When the voltage source 150 applies the desired voltages and currents to the electrodes 130, electrons are donated from the anode 131 are used to reduce the hydrogen protons in the electrolyte. This action generates hydrogen gas bubbles 140 on the surface of the cathode 132 that rise through the electrolyte 120 and fills a head space 145 above the electrolyte in the chamber. The generated hydrogen gas provides the desired buoyancy.

In one embodiment, the engine chamber 110 includes at least one gas vent 170 and allows a plurality of gas vents. The buoyancy engine chamber 110 includes at least one fluid inlet 180 and preferably a plurality of fluid inlets. Suitable vents and inlets include valves. Suitable valves include solenoid valves and other controllable valves.

The valves are in communication with a control system 160 that is used to open and close the valves as desired. Suitable control systems are known and available in the art.

The control system 160 is also in communication with and supplied by the power supply 150. By controlling the opening and closing of the valves for the gas vents, fluid inlets, and the supply of power to the electrodes; the buoyancy engine 100 through the control system 160 regulates the amount of electrolyte and gas in the chamber; and therefore, the buoyancy.

In one embodiment, the buoyancy engine chamber 110 also includes a pressure relief valve 190 to prevent overpressurization.

Figure 2:
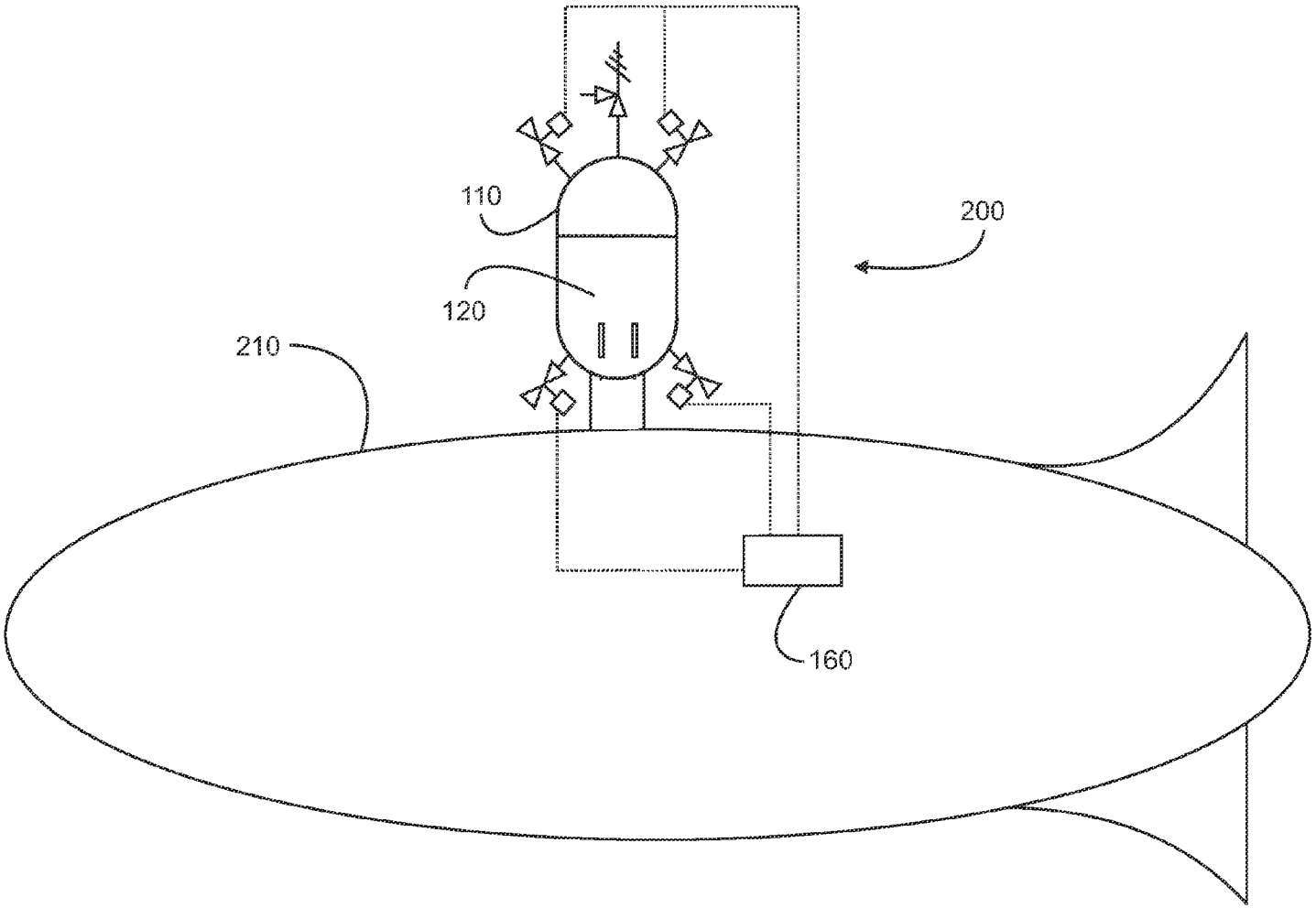
FIG. 2 is a schematic of another embodiment of an electrochemical buoyancy engine in accordance with the present invention with the embodiment including an autonomous undersea sensor platform.

Referring to FIG. 2, the present invention is directed to a system with the electrochemical buoyancy engine 200 and includes a marine vessel 210 attached to the chamber 110. The marine vessel 210 is an autonomous undersea sensor platform that includes an array of sensors. The other components of the buoyancy engine 200 are the same as in other embodiments. The power supply 150 and control system 160 are disposed within the marine vessel. In one embodiment, the chamber 110 is disposed within the marine vessel 210.

Exemplary embodiments of the present invention are also directed to a method of adjusting buoyancy in a marine vessel by introducing a volume of electrolyte into a water-tight and gas-tight chamber attached to the marine vessel and producing hydrogen gas in the chamber by reducing protons in the electrolyte. The hydrogen gas produced by the reduction reaction is trapped in the chamber. Preferably, the electrolyte is seawater. In one embodiment, the chamber is constructed from an expandable membrane.

In one embodiment, the hydrogen gas is produced using one of two electrodes located in the chamber and disposed in the electrolyte to contribute electrons for the reduction of protons in the electrolyte. In order to contribute the necessary electrons to the reduction reaction; a sufficient voltage and current across is applied across the two electrodes. This voltage can be applied using a power supply from the marine vessel.

It will be understood that many additional changes in details, materials, steps, and arrangements of parts which have been described herein and illustrated in order to explain the nature of the invention, may be made by those skilled in the art within the principle and scope of the invention as expressed in the appended claims.

What is claimed is:

1. An electrochemical engine for buoyancy, said engine consisting of:

a chamber having an expandable membrane within and at least one vent penetrating said chamber to an environment outside of said chamber and at least one fluid inlet penetrating said chamber;

a volume of seawater as an electrolyte fluid contained in said chamber; and a pair of electrodes disposed in said volume wherein one of said electrodes is an anode of magnesium material and another of said electrodes is a cathode of platinum material such that a difference in galvanic potential in seawater is more cathodic as −1000 millivolts as compared to a saturated calomel electrode;

wherein electrons are donated from said anode for reduction of hydrogen protons in said volume and generating an amount of hydrogen gas on a surface of said cathode by a reaction $2H^{+}+2e^{-}2H \rightarrow H_2$ (g) without a need for an external voltage source and in which the amount of hydrogen gas rises in said chamber for buoyancy;

wherein said chamber comprises a pressure relief valve fluidly connected to said chamber wherein said relief valve is capable of relieving pressure from said chamber to the outside of said chamber.

* * * * *